US006904942B2

(12) United States Patent
Odenthal

(10) Patent No.: US 6,904,942 B2
(45) Date of Patent: Jun. 14, 2005

(54) COMPOSITE FABRIC

(75) Inventor: Heinz Odenthal, Monheim (DE)

(73) Assignee: Andreas Kufferath GmbH & Co. KG, Düren (DE)

( * ) Notice: Subject to any disclaimer, the term of this patent is extended or adjusted under 35 U.S.C. 154(b) by 175 days.

(21) Appl. No.: 10/344,376

(22) PCT Filed: Aug. 14, 2001

(86) PCT No.: PCT/EP01/09398

§ 371 (c)(1),
(2), (4) Date: Feb. 11, 2003

(87) PCT Pub. No.: WO02/14601

PCT Pub. Date: Feb. 21, 2002

(65) Prior Publication Data

US 2003/0178087 A1 Sep. 25, 2003

(30) Foreign Application Priority Data

Aug. 16, 2000 (DE) ..... 100 39 736

(51) Int. Cl.[7] ..... D03D 13/00

(52) U.S. Cl. ..... 139/383 A; 139/425 A; 162/903; 442/205; 442/203

(58) Field of Search ..... 139/383 R, 383 A, 139/425 A; 162/903; 442/203, 205

(56) References Cited

U.S. PATENT DOCUMENTS 5,454,405 A 10/1995 Hawes
5,881,764 A 3/1999 Ward
5,967,195 A 10/1999 Ward
6,155,308 A * 12/2000 Kuji ..... 139/410
6,227,255 B1 * 5/2001 Osterberg et al. ..... 139/383 A
6,244,306 B1 * 6/2001 Troughton ..... 139/383 A
6,253,796 B1 * 7/2001 Wilson et al. ..... 139/383 A
6,334,467 B1 * 1/2002 Barrett et al. ..... 139/383 A
6,354,335 B1 * 3/2002 Taipale et al. ..... 139/383 A
6,379,506 B1 * 4/2002 Wilson et al. ..... 162/348
6,413,377 B1 * 7/2002 Wright ..... 139/383 A
6,427,728 B1 * 8/2002 Maguire et al. ..... 139/383 A
6,533,901 B2 * 3/2003 Taipale ..... 162/348
6,585,006 B1 * 7/2003 Wilson et al. ..... 139/383 A

FOREIGN PATENT DOCUMENTS

WO 9961698 12/1999

* cited by examiner

*Primary Examiner*—John J. Calvert
*Assistant Examiner*—Robert H. Muromoto, Jr.
(74) *Attorney, Agent, or Firm*—Roylance, Abrams, Berdo & Goodman L.L.P.

(57) ABSTRACT

A composite fabric, particularly for a paper making wire, contains at least two warp sheets (10, 12) of individual warp threads (8). One of the warp sheets (10) forms an upper side (14) of the fabric. Another warp sheet (12) forms a lower side (16) of the fabric. Weft threads (18, 20) are woven into at least the warp sheet (10) which constitutes the upper side (14). By creating an alternating pattern (22) for the warp threads (8) of one warp sheet (10), at least one pair of weft threads (18, 20) are interlaced in the form of supporting weft threads. One of the weft threads (18) then produces an alternating pattern (22) for a predetermined number of warp threads (8). The other weft thread (20) belonging to the pair runs at least partially between both warp sheets (10, 12) and is used as a supporting bridge (24) for several successive warp threads (8) within the respective pattern (22). The two weft threads (18, 20) of each pair of weft threads intersect each other at predetermined points (26). The weft thread (18) forming the pattern (22) is embodied as a thread-supporting bridge (24) and vice-versa, providing transversal stability and at the same time ensuring that the composite fabric is held in a highly flexible manner.

10 Claims, 4 Drawing Sheets

COMPOSITE FABRIC

FIELD OF THE INVENTION

The present invention relates to a composite fabric for a paper machine having at least two warp sheets formed of individual warp threads. One of the warp sheets forms the fabric upper side. The other warp sheet forms the lower side of the fabric. Weft threads are woven at least into the warp sheet forming the upper side.

BACKGROUND OF THE INVENTION

The demands set by the paper making industry for the tension of wires in the form of paper machine wires have risen sharply within the sheet-forming zone since introduction of so-called gap former technology. Consequently, both better dimensional stability in the transverse and longitudinal directions of the fabric in the event of high initial moisture removal accompanied by high retention and a low-marking wire surface structure are currently required of look-through wires. At the same time, the paper machine wire is expected to have an ever longer service life despite the constantly increasing production speeds.

The aggregate of the pertinent requirements contains a large number of contradictory quality demands made of the look-through wire. In the course of time, solutions have been proposed for many of the problems areas previously mentioned.

AT 28 339 B discloses a composite fabric for a paper machine wire with an upper and a lower sheet, that is, with two warp sheets. The two warp sheets optionally have weft or warp threads, with one of the warp sheets forming an upper side and another warp sheet forming the lower side of the fabric. Weft threads are woven at least into the warp sheet forming the upper side. Weft threads in the form of associated pairs both continuously overlap and underlap the individual warp threads of the two fabric sheets. The disclosed composite fabric results in an especially firm bond, but is characterized by low flexibility when applied and is subject to extensive wear.

DE 32 29 307 A1 discloses weaving of three superimposed weft sheets into a densely filled warp to produce high bending strength in the transverse direction. The longitudinal direction remains flexible to the same extent as known for double-sheet wires, described in U.S. Pat. Nos. 4,071,050, 4,041,989, and 4,112,982.

A second warp sheet is to be bound into the fabric to increase the stability of the fabric in the longitudinal direction as well. Conventional original forms of the relevant composite fabric are described in DE 29 17 694 A1 and in EP 0 141 791 A1. In DE 29 17 694 A1, two complete single-sheet fabrics are bound by a binding weft system. In EP 0 141 791 A1, a single-sheet fabric is bound to a two-sheet wire by binding threads.

Since additional binding threads disrupt the uniform surface structure of the fabric, the concept of separate binding threads in composite fabrics was abandoned, and the binding threads were incorporated into the surface structure of the fabric. Examples of the latter process are in U.S. Pat. No. 5,152,326, EP 0 069 101 A1, and PCT/WO 99/06630. In this new type of composite fabric, the conventional binding thread has been replaced by a pair of binding threads. This pair of binding threads exerts a supplementary effect in the fabric, in that, in the areas in which the first of these two binding threads is bound into the upper sheet of the fabric in the form of a fiber-bearing thread, the second binding thread binds to the warp of the lower fabric. The two threads thus intersect in the interior of the fabric structure and then exchange the functions they perform relative to fiber support and binding of the fabric sheets. The resulting advantage is represented by the substantially more rigid fabric binding of upper sheet and lower sheet. In the case of these fabrics, the situation is such that the diameter to be selected for the pair of binding threads is just as large as the diameter of the other transverse threads in the upper fabric.

Almost all of the composite fabrics of this type, whether the binding is effected by the conventional binding weft (DE 29 17 694 A1) or by a pair of binding threads (U.S. Pat. No. 5,152,326), have in common that the upper side of the fabric is preferably designed as a basket weave. A weave of this type causes the least marking in the paper and has the highest fiber support index. In the basket weave, each weft wire is bent around each warp wire. As a result, a large number of uniform points of application is created for the paper fibers. From the viewpoint of stability, however, the basket weave is the most unstable form of weave for a paper machine wire. Every bend in the weft around the warp may also be regarded as an impressed hinge or link point, so that precisely the basket-weave fabric possesses the highest turning and bending capability. In the case of composite fabrics, the fabric structure is stabilized in that the lower fabric is in the form of at least a four-shank fabric, preferably as a five-shank and in rare cases a six-shank fabric. These stable weaves, in conjunction with the basket weave on the upper side, also result in a total fabric characterized by acceptable performance and use data.

The constantly increasing production speeds in the paper machine industry and the associated increasing loads placed on paper machine coverings, however, necessitate continuous improvement in the stability requirements.

U.S. Pat. Nos. 5,881,764 and 5,967,195 disclose generic papermaking wires. Their thread-bearing bridge is in the form of a support weft thread, supporting a maximum of four warp threads of the upper fabric and extending at the maximum along four warp threads of the lower fabric. The support situation for the thread-bearing bridge occurs only once within a repeat of an eight or ten shank binding. Otherwise, only two or three warp threads of the upper fabric are supported. The thread-supporting bridge also extends along only two or three warp threads of the lower fabric, which to this extent in turn support the thread-supporting bridge. Consequently, since the thread-bearing bridge formed is designed to float only for a brief period, this bridge also extends at least in part along an oblique path plane, impairing the behavior of the binding between the fabric sheets. Accordingly, the support weft threads also alternate rapidly between formation of the thread-bearing bridge and of the alternating encircling pattern for the upper fabric. In this way, a plurality of binding points of the respective support weft thread is achieved in the lower fabric, to achieve secure binding of upper and lower fabric sheets. Because of the plurality of binding points thereby achieved, the fabric binding is relatively rigid, something which has an unfavorable effect in the reversal areas for the papermaking wire. In addition, friction occurs between the fabric sheets, and is accompanied by correspondingly high wear of the composite fabric.

SUMMARY OF THE INVENTION

Objects of the present invention are to provide an improved composite fabric which meets higher stability requirements and yet is designed to be very flexible.

According to the present invention, in at least one part of the thread-supporting bridges, the respective support weft thread forming the bridge extends directly and for a long period floating along at least five warp threads of the upper fabric, and along at least five warp threads of the lower fabric. Additional support for these thread-bearing bridges is achieved a binding or connecting thread extending beneath these bridges. High transverse stability is achieved, and at the same time, the composite fabric is kept very flexible. Contributing to the high stability is, at least in part, support for the respective thread-bearing bridge is again achieved by the connecting or binding thread extending underneath the bridge.

The composite fabric of the present invention is characterized especially by the subsequent progress of the pair in the course of the subsequent repeat. This first weft thread is guided, after its intersection with the second weft thread, so as to be straight floating beneath the warp threads of the upper fabric to form a supporting weft thread bridge for these warp threads in the area of the repeat in which the second weft thread is woven into these warp threads until it intersects again with the second weft thread at the end of the repeat, and thus, ties into the warp of the upper fabric. The transverse stability of the upper fabric is significantly increased by this support or thread bridge. The second weft thread may also form this support bridge in the area of the first warp threads of the upper fabric, in that this second weft thread, providing support for this support bridge, lies under the first warp threads into which the first weft thread of the pair described ties.

A preferred embodiment of the composite fabric of the present invention is characterized in that the alternating encircling pattern produced by the respective weft thread pair encloses each individual warp thread sheet forming the upper side. In this preferred embodiment, the advantageous basket weave is achieved in the area of the upper side. Its instabilities are offset by the thread-bearing bridges.

In another preferred embodiment of the composite fabric of the present invention, the encircling pattern selected, made up of the respective weft thread of a pair, is such that it overlaps every other warp thread of the upper warp thread sheet. The outer sheets of the weft thread forming the encircling pattern in each case for a fiber-bearing element in the surface structure of the wire. The arrangement selected makes available a plurality of fiber-bearing fiber parts, something which results in decidedly low-marking wire surface structures.

Another preferred embodiment of the composite fabric of the present invention is characterized in that the weft thread of the respective weft thread pair, which does not form the alternating encircling pattern, enters into a weave with weft threads of the lower warp threads of the lower warp thread sheet at predetermined points. Binding of the lower fabric to the upper fabric without exerting a negative influence on the structure of the upper fabric itself is thereby achieved. Preferably, other weft threads joining the warp threads to each other may be provided in addition to the supporting weft threads. Provision may optionally be provided such that each supporting weft pair performs a function of binding to the lower warp threads or such that, independently of this arrangement, other weft thread sheets assume the function of binding to the lower warp threads. Every second, third, fourth, etc. weft thread may be such a binding thread in sequence, and in alternating sequences.

In another preferred embodiment of the composite fabric of the present invention, the support threads are of differing materials, in particular one of a polyester and the other of a polyamide material. A general problem of composite fabrics, regardless of whether made with conventional binding threads or with binding pairs, is proper selection of the material for the respective binding thread. In addition to polyamide materials, use is also made of polyester materials. Since polyamide absorbs moisture, the respective material to a great extent loses its bending resistance because of the moisture absorption. Producers of wires exercise reserve in using polyamide out of consideration for transverse stability. A problem is inherent, especially in wires made with the supporting pair of binding threads. Since each thread of these pairs binds and has to support fiber material, in equal proportions, both threads must be made of the same material. Differing materials may lead to problems and automatically to marking problems. Accordingly, when polyamide is selected for the wire in the state of the art, hardly any alternative remains available, but with the consequence that the material in question of the upper sheet fabric is a destabilizing factor.

Since in the present invention at least one weft thread of the pair referred to forms the thread-bearing bridge for additional stiffening of the upper fabric, an additional option exists in the choice of the material for this weft thread pair in the event that the second weft thread performs a binding function. Hence, the first weft thread selected for this pair which performs the support function may be of hard polyester quality. In contrast, the second weft thread, which performs an additional binding function, may be of a polyamide to ensure wear-resistant binding to the lower fabric.

For the purposes of straight-floating bindings, it is advantageous to provide the alternating encircling pattern in a binding repeat which has eight, ten, or twelve warp threads in the upper fabric.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
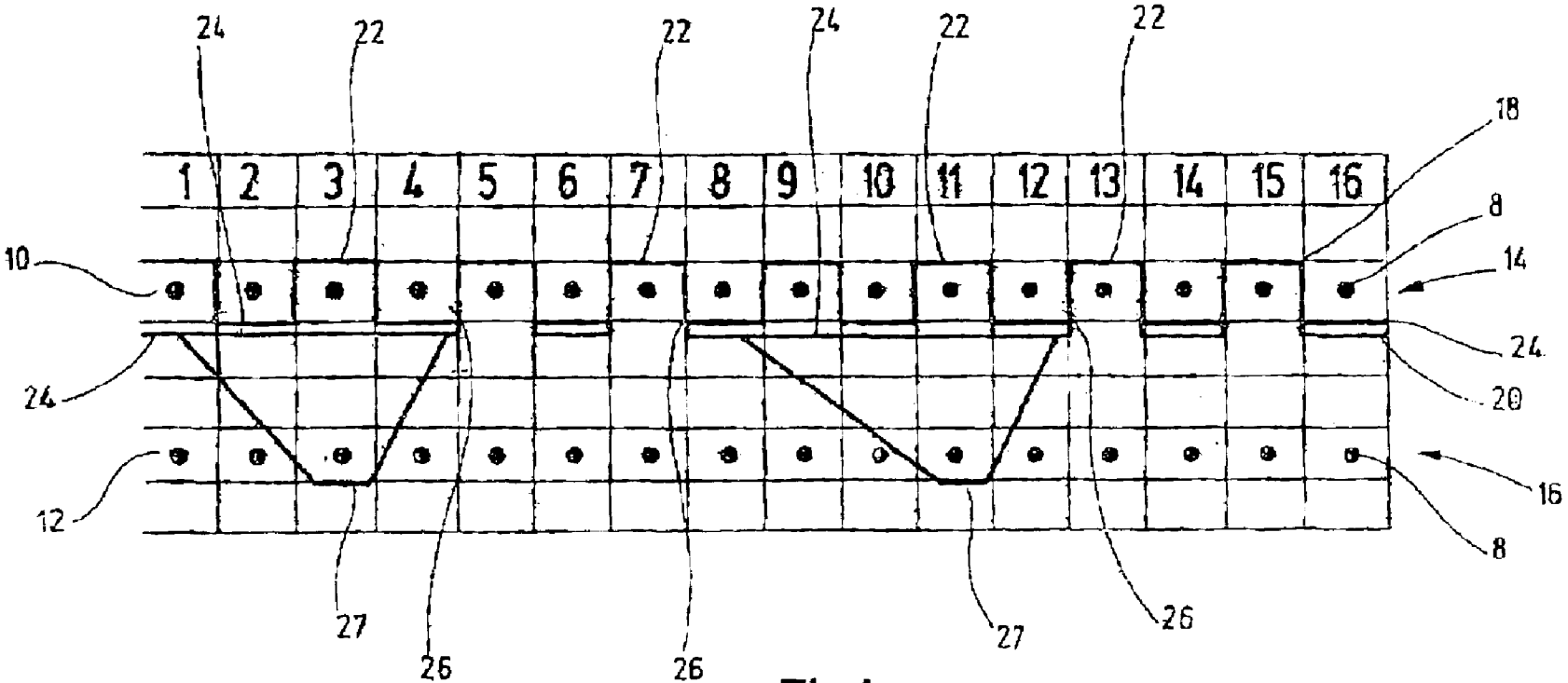
FIG. 1 is a diagrammatic end elevational composite fabric with 16 pairs of warp threads (eight-shaft binding) identified by Arabic numerals 1 to 16.

The composite fabric show in FIG. 1, when of suitable length and width, may be used in particular for preparation of a paper machine wire. The composite fabric has two warp sheets 10, 12 including individual warp threads 8. The upper warp sheet 10, as viewed in FIG. 1 forms the upper side 14, while the subjacent warp sheet 12 forms the lower side 16 of the fabric. In addition, two weft threads 18, 20 are woven into the warp sheet 10 forming the upper side 14 and extending transversely to the warp threads 8. To form an alternating encircling pattern 22 for the warp threads 8 of the upper warp sheet 10, a pair of associated weft threads 18, 20 is woven in as support weft threads. One weft thread 18, starting on the left, as viewed in FIG. 1, produces the alternating encircling pattern 22 for a predetermined number of warp threads 8, in this instance the warp threads with the consecutive numbers 1, 2, and 3. The other weft thread 20 of this pair, extends between the two warp sheets 10, 12, and serves as thread-supporting bridge 24 for the superjacent warp threads 8 within the framework of the first encircling pattern 22. The weft threads 18, 20 in this weft thread pair subsequently intersect at the predetermined point 26. In this way, the weft thread 18 initially forms the encircling pattern 22 and becomes the thread-supporting bridge 24. The weft thread 20 initially forms the thread-supporting bridge 24 and subsequently produces the alternating encircling pattern 22 for the subsequent warp threads 8. The alternating encircling pattern 22 is in the form of a meandering binding for the individual warp threads 8 of the upper fabric.

The encircling pattern 22 made up of the respective weft threads 18, 20 of a particular weft thread pair is selected so that it overlaps every other warp thread 8 of the upper warp sheet 10 toward the exterior. Consequently, every other warp thread 8 in the alternating row, identified by the numerals 1, 3, 5, 7, 9, etc. in accordance with the section of the total fabric as illustrated in the drawing, makes a contribution to fiber support. The respective fiber support surface is significantly enlarged by the encircling structure selected in the form of the encircling pattern 22, resulting in low-marking structures in subsequent manufacture of the paper material.

A fabric produced according to the present invention consequently is characterized by the circumstance that every weft thread 18, 20, which is bound into the wire surface 14, makes a contribution toward fiber support. Every weft thread 18, 20 is a support weft, and thus, a fiber-supporting element in the surface structure of the wire. Every weft thread 18, 20 in the binding repeat of the upper side 14 encircles the warp threads (1, 3) at least twice starting from the upper side, on the basis of four consecutive warp threads (1, 2, 3, 4) of the upper fabric 14. In one preferred embodiment of the upper side 14 in the definition of the basket weave illustrated, this means that, for example, a weft thread 18 or 20 encircles the first and third or the second and fourth warp thread 8 as viewed from above. Thus, the respective weft thread 18 or 20 forms in the binding repeat of the upper side 14 at least two support points per repeat for the paper fibers (not shown) of the sheet of paper being formed. A second weft thread 20, which acts in conjunction with the first weft thread 18 just described, crosses this first weft thread 18 beneath the fourth or fifth warp thread 8 of the upper fabric 14 and encircles the fifth and seventh or the sixth and eighth warp thread 8 of the upper fabric 14, if the latter is expressed as having eight shanks. In the case of a ten-shank definition, the second weft thread 20 would also still encircle the ninth or tenth warp thread 8 of the upper fabric repeat from above. The required number of weft threads 18, 20 which are to be introduced into the upper side 14 as support thread pair 20 is determined on the basis of the lateral stability requirements set for the wire. It is nevertheless theoretically possible for the entire weft furnish for the upper side 14 to be in the form of the support thread pair 18, 20.

As is also to be seen from FIG. 1, the weft thread 18 or 20 of the respective weft thread pair which does not directly form the alternating encircling pattern 22 may also enter into a bond with predetermined points with warp threads 8 of the lower warp thread sheet 12. This bond is indicated by broken lines in the figure. In addition, it is possible for every second or third, etc. weft furnish in the upper fabric 14 to be in the form of the support weft thread pair 18, 20. The binding to the lower fabric sheet 16 with its warp threads 8 is effected, as illustrated in FIG. 1, by way of connecting or binding threads 27. One such thread in the respective fabric sheet is sufficient for achievement of secure bonding of the lower fabric 16 to the upper fabric 14. Because of the fiber or support bearing beneath the respective alternating connecting pattern, conventional complicated systems of connecting and binding thread pairs may be dispensed with. As is shown by FIG. 1, the respective binding to the lower fabric 16 is effected in places in which the thread-supporting bridge is formed. Consequently, additional support of the thread bridge may be achieved at least in part by way of the subjacent binding or connecting threads.

The other, second, embodiment as shown in FIG. 2 et seq. corresponds to the first embodiment shown in FIG. 1. However, now a ten-shank binding is employed inside the respective repeat rather than an eight-shank binding.

Consequently, the same reference numerals as those in FIG. 1 have been used for the second embodiment. What has been stated up to this point applies as well to the embodiment described in the following.

Figures 2A, 2B:
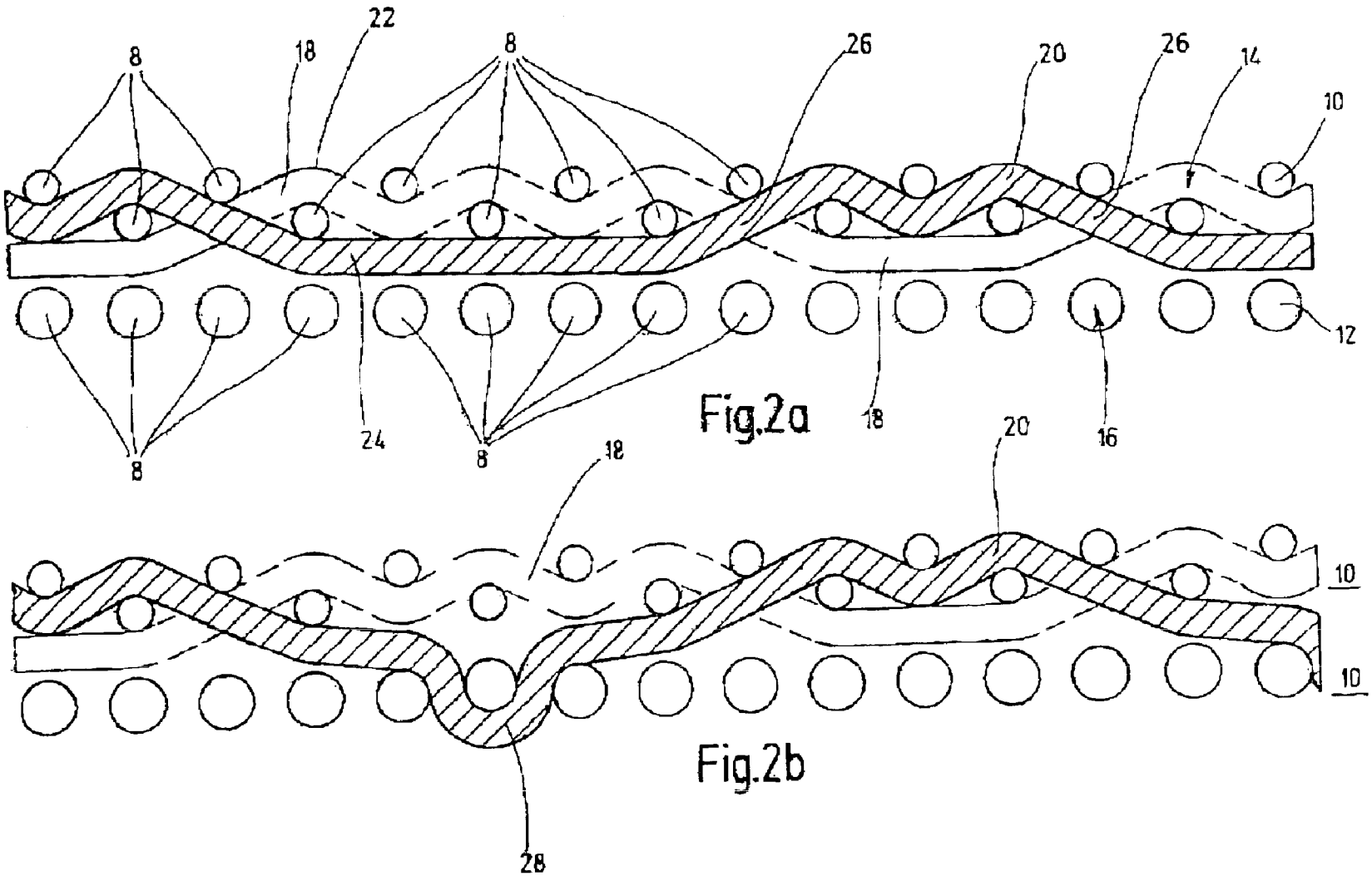
FIGS. 2*a* and *b* are full-size representations of the composite fabric of FIG. 1, in the form of a ten-shaft binding, the figures relating respectively to two different binding patterns within a repeat.

As the embodiment shown in FIG. 2*a* et seq. shows, the warp threads 8 of the lower side 16 are larger in diameter than the warp threads 8 of the upper side 14. Better support of the upper side 14 is obtained as a result by way of the lower side 16 and the diameter relationships selected.

Figures 3A, 3B, 3C, 3D, 3E, 3F, 3G, 3H, 3I, 3J:
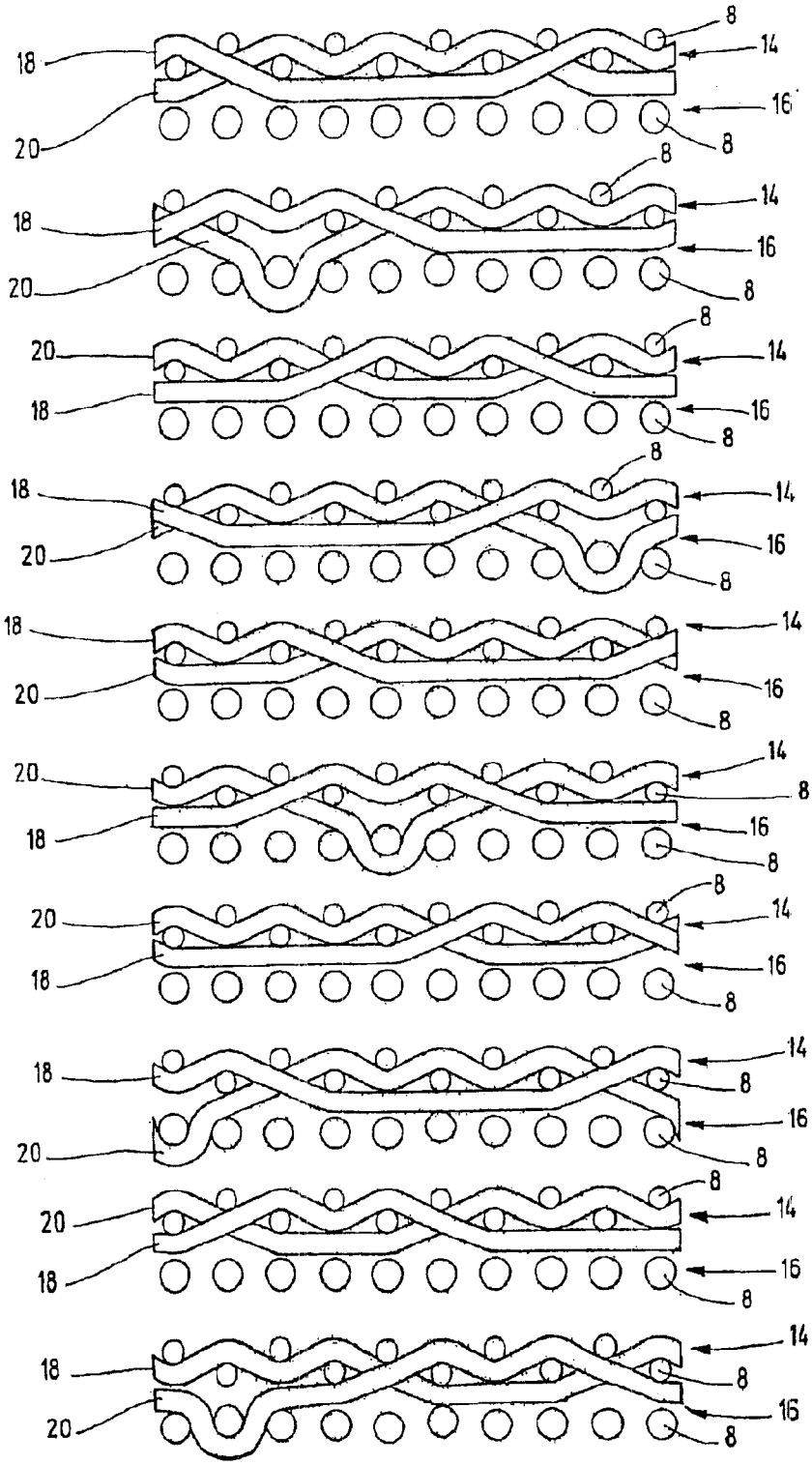
FIGS. 3*a–j* are side elevational views of individual fabric sheets within one ten-shaft repeat, the binding pattern shown being repeated in the following repeat.

Along with the connecting and binding threads 27 already referred to, the possibility also exists, as is to be seen in FIGS. 2*b* and 3 in particular, of weaving a support weft thread for a specific warp thread 8 of the lower fabric 16 into the latter. Thus, potential binding points between the fabric sheets may be made by way of a weft thread.

Figure 4:
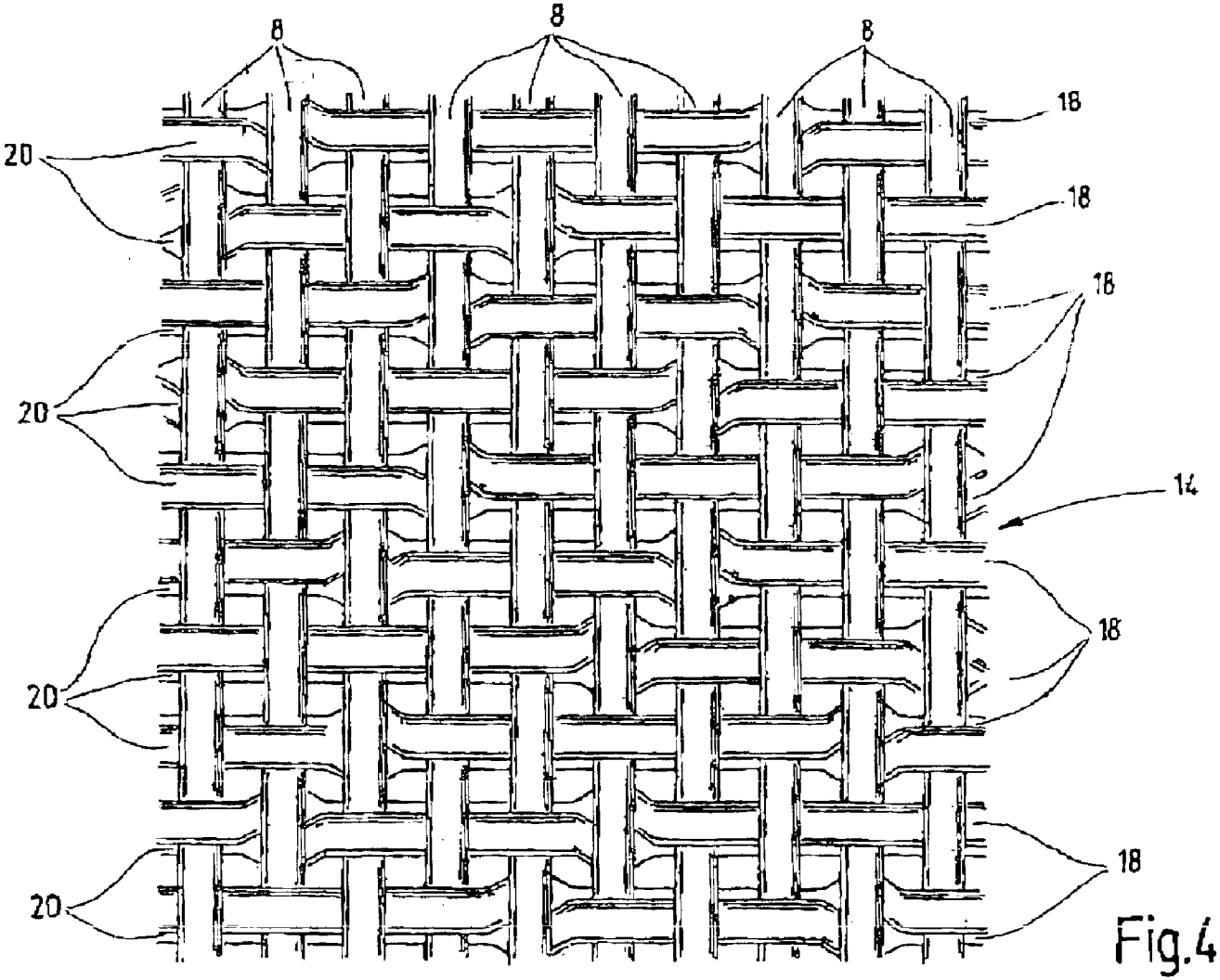
FIG. 4 is a top view of the upper side of the composite fabric of FIGS. 2*a*, 2*b* and 3.

As is also to be seen from FIG. 4, which illustrates the upper side 14 of the composite fabric, the arrangement of selected support weft threads 18, 20 as described in the foregoing results in a uniform fabric structure pattern characterized by high stability, good moisture removal performance, and in particular achievement of a low-marking wire surface structure.

While various embodiments have been chosen to illustrate the invention, it will be understood by those skilled in the art that various changes and modifications can be made therein without departing from the scope of the invention as defined in the appended claims.

What is claimed is:

1. A composite fabric for a paper machine wire, comprising:

a first warp sheet of individual warp threads forming a fabric upper side;

a second warp sheet of individual warp threads forming a fabric lower side;

at least one pair of associated support weft threads woven at least into said first warp sheet to form an alternating encircling pattern for said warp threads of said first warp sheet, a first weft thread of said pair producing said alternating encircling pattern for a predetermined number of said warp threads, a second weft thread of said pair extending at least in part between said first and second warp sheets to serve as a thread-supporting bridge for a plurality of consecutive ones of said warp threads within the respective encircling pattern, said first and second weft threads intersecting at predetermined points such that said first weft is designed for said thread-supporting bridge and vice versa, said thread-supporting bridge being formed by a portion of said second weft thread that is straight and straight-floating and extends along at least five warp threads of said second warp sheet; and a binding thread providing additional support for said thread-supporting bridge and extending underneath said thread-supporting bridge.

2. A composite fabric according to claim 1 wherein said alternating encircling pattern encircles each individual warp thread of said first warp sheet.

3. A composite fabric according to claim 2 wherein in said alternating encircling pattern, said first weft thread overlaps every other warp thread of said first warp sheet from an outside thereof.

4. A composite fabric according to claim 1 wherein said second weft thread, in place of a support area, enters at said predetermined points into a bond with warp thread of said second warp sheet.

5. A composite fabric according to claim 1 wherein other binding threads connect said first warp sheet to said second warp sheet, in addition to said weft threads.

6. A composite fabric according to claim 1 wherein said weft threads are formed of different materials.

7. A composite fabric according to claim 6 wherein one of said weft threads is of polyester material; and another of said weft threads is of a polyamide material.

8. A composite fabric according to claim 1 wherein said alternating pattern comprises a binding repeat of eight warp threads of said first warp sheet.

9. A composite fabric according to claim 1 wherein said alternating pattern comprises a binding repeat of ten warp threads of said the warp sheet.

10. A composite fabric according to claims wherein said alternating pattern comprises a binding repeat of twelve warp threads of said first warp sheet.

* * * * *